US010215026B2

(12) United States Patent
Yoon

(10) Patent No.: US 10,215,026 B2
(45) Date of Patent: Feb. 26, 2019

(54) PUMP MODULE AND ELECTRIC PUMP INCLUDING THE SAME

(71) Applicant: LG INNOTEK CO., LTD., Seoul (KR)

(72) Inventor: Ho Eop Yoon, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 637 days.

(21) Appl. No.: 14/547,216

(22) Filed: Nov. 19, 2014

(65) Prior Publication Data

US 2015/0139831 A1 May 21, 2015

(30) Foreign Application Priority Data

Nov. 19, 2013 (KR) ..... 10-2013-0140729

(51) Int. Cl.

| | |
|---|---|
| ***F04C 2/12*** | (2006.01) |
| ***F04C 15/00*** | (2006.01) |
| ***F01C 21/10*** | (2006.01) |
| ***F04C 2/10*** | (2006.01) |
| ***F04C 11/00*** | (2006.01) |

(52) U.S. Cl.

CPC ..... *F01C 21/10* (2013.01); *F04C 2/102* (2013.01); *F04C 11/008* (2013.01); *F04C 2240/70* (2013.01)

(58) Field of Classification Search

CPC ..... F04C 2/126; F04C 11/008; F04C 2/102
USPC ..... 417/410.4; 418/61.3
See application file for complete search history.

(56) References Cited

U.S. PATENT DOCUMENTS

| | | | | |
|---|---|---|---|---|
| 4,492,539 | A * | 1/1985 | Specht | F04C 14/22 418/171 |
| 5,710,474 | A * | 1/1998 | Mulgrave | H02K 1/12 310/156.25 |
| 2005/0063851 | A1* | 3/2005 | Phillips | F04C 2/084 418/61.3 |
| 2010/0040488 | A1* | 2/2010 | Yukitake | H02K 1/02 417/410.1 |
| 2011/0135516 | A1* | 6/2011 | Oishi | F01C 21/02 417/410.4 |
| 2011/0194954 | A1* | 8/2011 | Sakata | F04C 11/008 417/410.1 |

(Continued)

FOREIGN PATENT DOCUMENTS

| | | |
|---|---|---|
| CN | 102966542 | 3/2013 |
| DE | 10 2009 021 890 A1 | 12/2009 |

(Continued)

OTHER PUBLICATIONS

European Search Report dated Jun. 8, 2015 issued in Application No. 14193578.3.

(Continued)

*Primary Examiner* — Dominick L Plakkoottam
(74) *Attorney, Agent, or Firm* — Ked & Associates, LLP

(57) ABSTRACT

A pump module may include a pump rotor coupled to a rotating shaft of a motor, and a pump housing configured to accommodate the pump rotor. The pump housing includes a rotor accommodating part having an insertion groove formed therein to accommodate the pump rotor, and a cover connected with the rotor accommodating part and having a fluid sucking hole and a fluid discharging hole.

19 Claims, 4 Drawing Sheets

(56) References Cited

U.S. PATENT DOCUMENTS

| | | | | |
|---|---|---|---|---|
| 2013/0052058 | A1* | 2/2013 | Motohashi | F01C 21/02<br>417/410.4 |
| 2013/0202464 | A1* | 8/2013 | Miyaki | F01C 21/10<br>417/410.4 |
| 2014/0321230 | A1* | 10/2014 | Smith | F04C 2/102<br>366/134 |

FOREIGN PATENT DOCUMENTS

| | | | |
|---|---|---|---|
| DE | 10 2012 210 197 | A1 | 5/2013 |
| DE | 10 2012 219 841 | A1 | 10/2013 |
| JP | 2013-199922 | A | 10/2013 |

OTHER PUBLICATIONS

Chinese Office Action dated May 15, 2018 issued in Application No. 201410663069.2 (English translation attached).

* cited by examiner

PUMP MODULE AND ELECTRIC PUMP INCLUDING THE SAME

CROSS-REFERENCE TO RELATED APPLICATION

This application claims priority under 35 U.S.C. § 119 to Korean Application No. 10-2013-0140729 filed on Nov. 19, 2013, whose entire disclosure is incorporated herein by reference.

BACKGROUND

1. Field

The present disclosure relates to a pump module and an electric pump including the same, and more particularly, to an electric oil pump.

2. Background

An oil pump serves to discharge a flow rate of oil with a constant pressure. Oil circulated by the oil pump is used to operate a hydraulic system using an oil pressure, or to obtain a cooling or lubricant effect. A mechanical oil pump (MOP) is an oil pump operated using mechanical power such as an engine.

Recently, studies on hybrid vehicles and electric vehicles have been carried out to improve fuel efficiency and to reduce carbon emission. Therefore, demand for electric oil pumps (EPOs) is being increased, instead of the MOP using mechanical power.

The EOP has a pump-integrated structure in which a housing of a pump is integrally formed with a housing of motor. The pump-integrated structure has advantages including a reduced volume and a light weight. However, the pump may be damaged while the motor is assembled. Further, in a new development on the EOP, the motor should be redesigned even by a minor design change of the pump, so it is difficult to standardize the EOP, and it is not possible to separately assemble and test the pump before an assembling of the pump and the motor.

BRIEF DESCRIPTION OF THE DRAWINGS

The embodiments will be described in detail with reference to the following drawings in which like reference numerals refer to like elements wherein.

DETAILED DESCRIPTION

Figure 1:
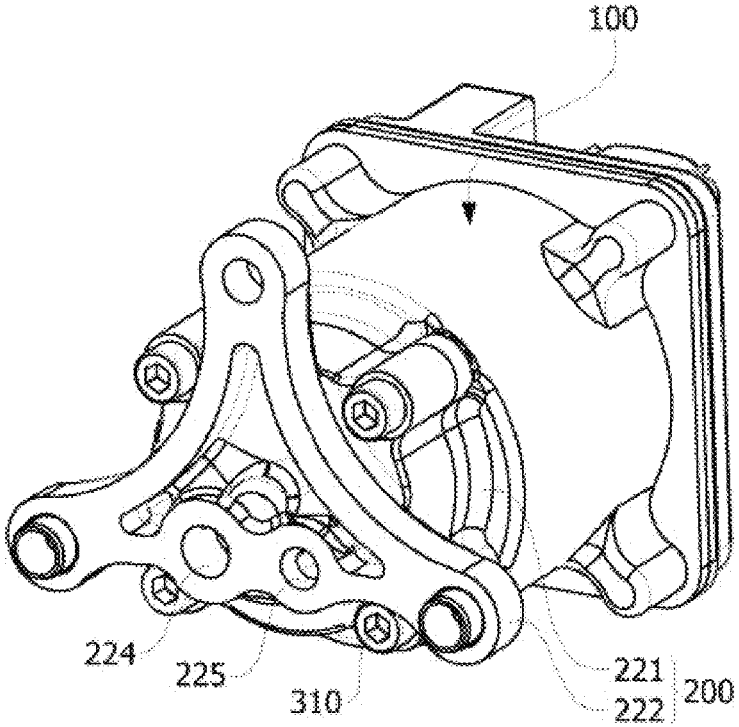
FIG. 1 is a perspective view illustrating an electric oil pump according to one embodiment of the present disclosure.
Figure 2:
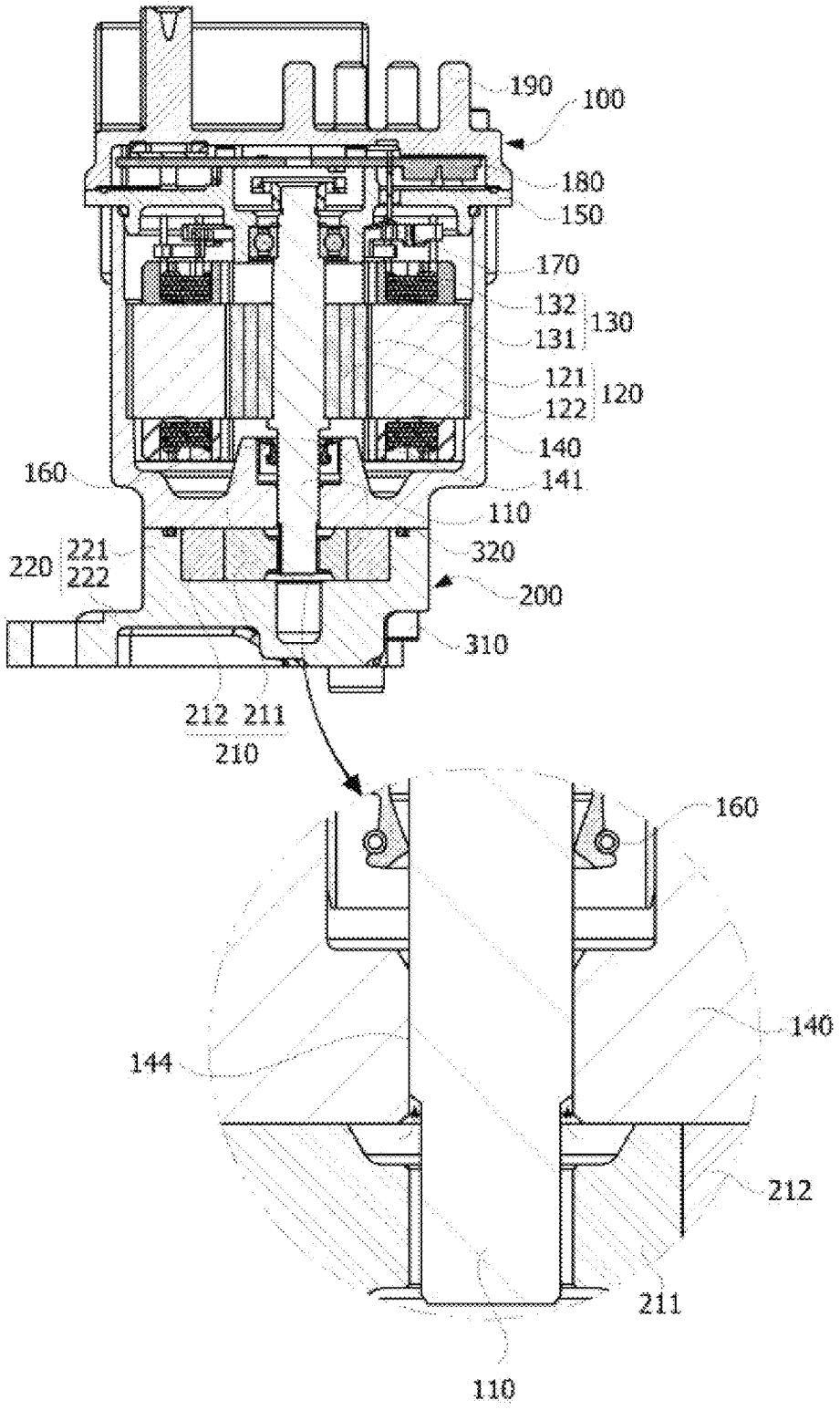
FIG. 2 is a side cross-sectional view illustrating the electric oil pump according to one embodiment of the present disclosure.
Figure 3:
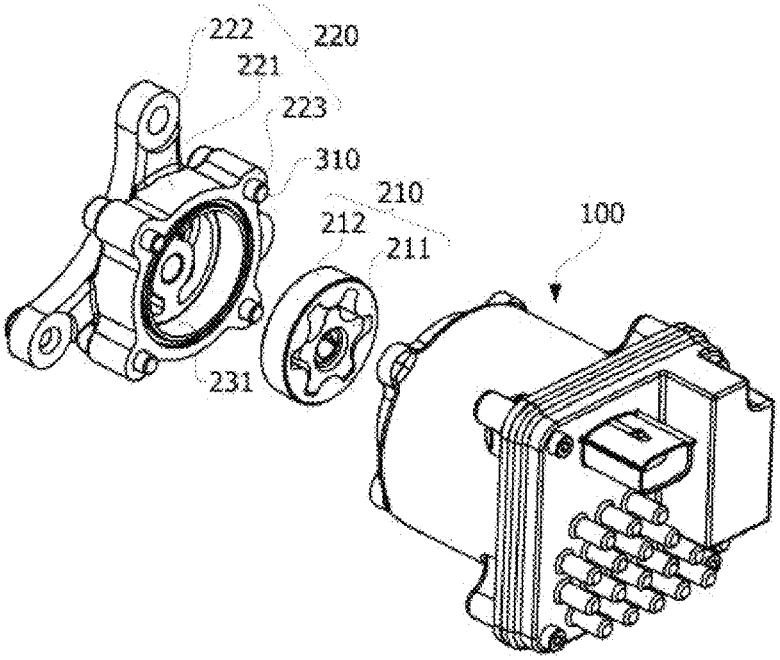
FIG. 3 is an exploded perspective view illustrating the electric oil pump according to one embodiment of the present disclosure.

Referring to FIGS. 1 to 3, the EOP according to one embodiment of the present disclosure includes a motor module 100 and a pump module 200. The motor module 100 includes a rotating shaft 110, a rotor 120, a stator 130, a motor housing 140, a first cover 150, a sealing member 160 and a bearing 170. The pump module 200 includes a pump rotor 210 and a pump housing 220. FIG. 2 illustrates an example in which the motor module 100 is an internal permanent magnet (IPM) type in which a rotor magnet 122 is inserted into a rotor core 121. However, the embodiment of the present disclosure is not limited thereto. The motor module according to another embodiment of the present disclosure may be a surface permanent magnet (SPM) type in which the rotor magnet is attached to an outer circumferential surface of the rotor.

The rotating shaft 110 is integrally coupled to a center portion of the rotor 120, and serves to transmit a rotating force according to rotation of the rotor 120 to the pump module 200. The stator 130 is fixed to an inner circumferential surface of the motor housing 140, and has a space formed therein to accommodate the rotor 120. The stator 130 includes a stator core 131 and a coil 132 wound on the stator core 131.

When a current is applied to the coil 132 of the stator 130, the rotor 120 is rotated by an electromagnetic interaction between the stator 130 and the rotor 120. Therefore, the rotating shaft 110 coupled to the rotor 120 is rotated along with the rotor 120, and thus the rotating force may be transmitted to the pump module 200.

The motor housing 140 is a cylindrical member of which an upper portion is opened, and the rotor 120 and the stator 130 are accommodated in an inner space thereof. The first cover 150 is airtightly coupled to the upper portion of the motor housing 140 in an air tight manner, or alternatively, hermetically sealed. For the sake of convenience of explanation, a motor module 100 side of FIG. 2 is defined as an "upper portion", and a pump module 200 side thereof is defined as a "lower portion".

A through-hole 144 through which the rotating shaft 110 passes is formed in a bottom surface of the motor housing 140. The through-hole 144 serves to support one end of the rotating shaft 110. Therefore, a separate bearing structure for supporting the one end of the rotating shaft 110 may be omitted. At this time, a fluid may be introduced into a gap between the through-hole 144 and the rotating shaft 110 and may perform a lubrication action.

A sealing member accommodating part 141 configured to accommodate the sealing member 160 is formed around the through-hole 144. The sealing member 160 is coupled with the rotating shaft 110 to surround an outer surface of the rotating shaft 110, and serves to prevent a fluid circulated in the pump module 200 from being introduced to the motor module 100 side. Since the sealing member 160 is disposed between the through-hole 144 and the rotor 120, the fluid introduced into the gap between the through-hole 144 and the rotating shaft 110 is not introduced to the rotor side.

The sealing member 160 may include an oil seal or the like. The bearing 170 is coupled to the outer surface of the rotating shaft 110 so as to rotatably support the other end of the rotating shaft 110.

The motor module 100 further includes a circuit board 180 and a second cover 190 which are coupled above the first cover 150. The circuit board 180 includes a motor driving part such as an inverter and an inverter driving circuit, and serves to supply a current to the stator 130 and thus rotate the rotor 120. The second cover 190 is coupled on the first cover 150 to seal the circuit board 180.

The pump rotor 210 includes an internal rotor 211 coupled with one end of the rotating shaft 110 so as to receive the rotating force from the rotating shaft 110, and an external rotor 212 configured to accommodate the internal rotor 211.

N lobes are formed on an outer circumferential surface of the internal rotor 211, and N+1 lobes are formed in the external rotor 212, and thus the internal rotor 211 is rotated at a rotation ratio of (N+1)/N.

The pump module 200 has a predetermined eccentric structure when the internal rotor 211 receives the rotating force from the rotating shaft 110 and is rotated. Due to the eccentric structure, a volume through which a fluid fuel is transported is generated between the internal rotor 211 and the external rotor 212. That is, a portion in which the volume is increased, when the pump rotor 210 is rotated, sucks a peripheral fluid due to a pressure drop, and another portion in which the volume is reduced discharges the fluid due to a pressure increase.

Figure 4:
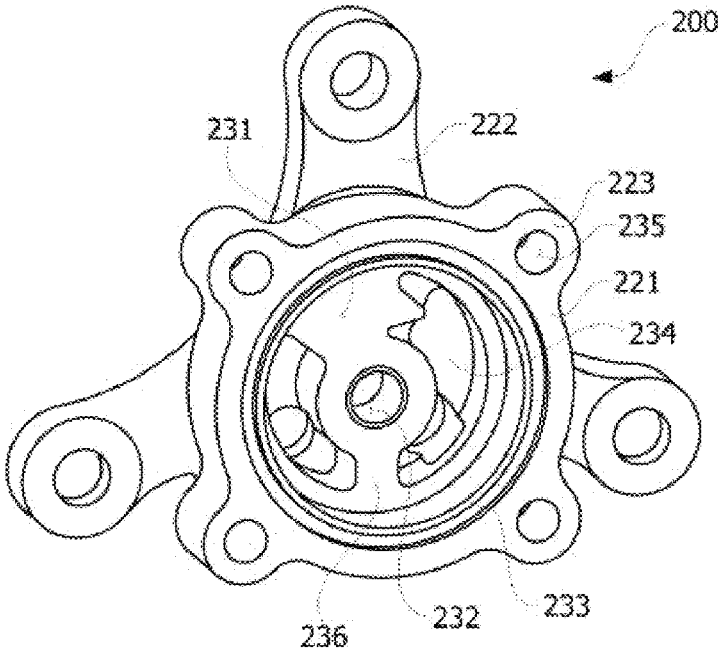
FIG. 4 is a perspective view illustrating a pump housing of the electric oil pump according to one embodiment of the present disclosure.
Figure 5:
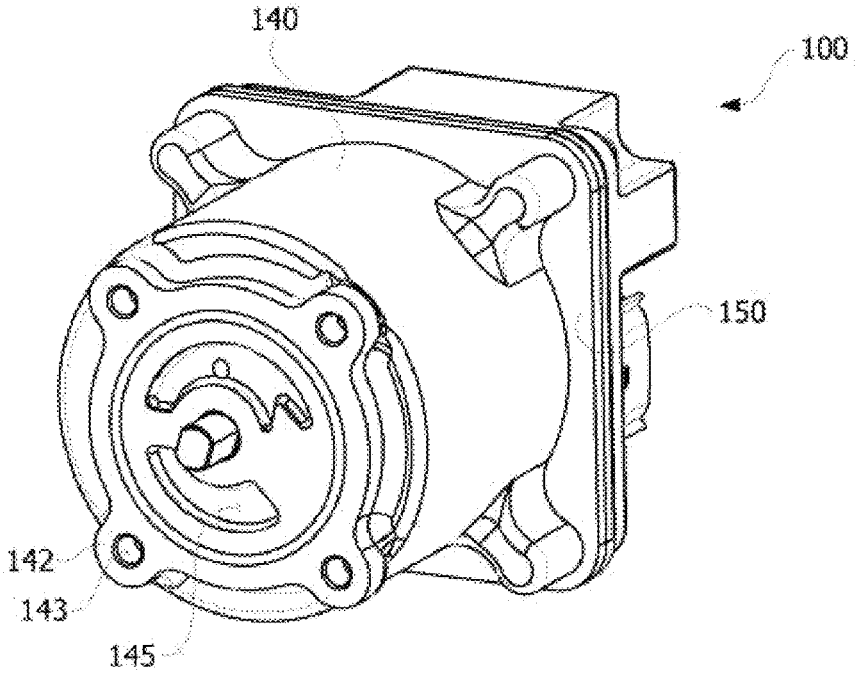
FIG. 5 is a perspective view illustrating a motor module of the electric oil pump according to one embodiment of the present disclosure.

The pump housing 220 includes a rotor accommodating part 221 formed therein to accommodate the pump rotor 210, and a third cover 222, and is coupled to one side of the motor housing 140 through a protrusion 223. Referring to FIGS. 3 to 5, the rotor accommodating part 221 is formed in a cylindrical shape of which one side is opened, and has an insertion groove 231 formed therein to accommodate the pump rotor 210. A depth of the insertion groove 231 may be the same as a thickness of the pump rotor 210, but not limited thereto.

The third cover 222 is integrally formed with the rotor accommodating part 221 and forms a bottom surface 236 of the insertion groove 231. An insertion hole 232 in which the rotating shaft 110 of the motor module 100 is inserted into a center portion thereof, and a main groove 234 configured to receive the fluid are formed in the bottom surface 236 of the insertion groove 231. Further, a fluid sucking hole 224 (FIG. 1) and a fluid discharging hole 225 (FIG. 1) are formed in a thickness direction to pass therethrough.

In the rotor accommodating part 221, a groove portion 233 in which an O-ring 320 is coupled is formed on one surface in contact with the motor housing 140. The groove portion 233 may be a ring-shape groove surrounding the insertion groove 231. The O-ring 320 is deformed when the pump housing 220 is coupled to one end of the motor housing 140 and a pressure is applied thereto, and fills up a gap between the two housings 140 and 220.

A plurality of protrusions 223 protrude from an outer circumferential surface of the rotor accommodating part 221. A through-hole 235 is formed at a center portion of each protrusion 223, and a screw thread to be screwed with a fastening member 310 is formed on an inner circumferential surface of the through-hole 235.

A coupling part 142 protrudes on one surface of the motor housing 140 to which the pump housing 220 is coupled. The coupling part 142 is formed of a ring shape of which a cross section corresponds to a cross section of the rotor accommodating part 221. The coupling part 142 is mated with one surface of the rotor accommodating part 221 to seal the rotor accommodating part 221.

A sub groove 145 in which the fluid is received may be formed in a bottom surface (facing the rotor accommodating part of the motor housing) of the coupling part 142. The sub groove 145 may be designed to have a smaller depth than that of the main groove 234.

A fastening groove 143 opposite to each through-hole 235 of the pump housing 220 is formed in the one surface of the motor housing 140 to which the pump housing 220 is coupled. A screw thread to be screwed with the fastening member 310 is formed on an inner circumferential surface of the fastening groove 143.

Each through-hole 235 of the pump housing 220 and each fastening groove 143 of the motor housing 140 are arranged on one straight line when the motor housing 140 is coupled with the pump housing 220. The fastening member 310 is sequentially fastened to the through-hole 235 and the fastening groove 143 so that the motor housing 140 is coupled with the pump housing 220. The fastening member 310 may include a bolt having a screw thread formed on an outer circumferential surface thereof.

The EOP according to one embodiment of the present disclosure may be serves as an oil pump, and if necessary, may be properly modified into various fluid pumping structures such as a water pump.

Since the EOP having the above-mentioned structure may be designed to have the shortest distance of a fluid channel, a volume loss due to flow friction may be reduced, and a compact design may be allowed.

Further, a function of accommodating the pump rotor may be removed from the motor housing, and the pump rotor accommodating space may be integrated to the pump cover, and thus the motor housing may be simplified.

Further, the pump module and the motor module may be mechanically separated, and separately assembled and tested, and thus the motor may be standardized.

A pump module may include a pump rotor coupled to a rotating shaft of a motor, and a pump housing configured to accommodate the pump rotor, wherein the pump housing includes a rotor accommodating part having an insertion groove formed therein to accommodate the pump rotor, and a cover connected with the rotor accommodating part and having a fluid sucking hole and a fluid discharging hole. The pump rotor may include an internal rotor coupled to the rotating shaft, and an external rotor configured to accommodate the internal rotor.

The rotor accommodating part may include a protrusion in which a fastening member is fastened. The rotor accommodating part may include a first groove formed in a bottom surface of the insertion groove to receive a fluid. The rotor accommodating part may include a groove portion configured to surround the insertion groove, and an O-ring arranged in the groove portion. The rotor accommodating part may include an insertion hole formed at a center of a bottom surface of the insertion groove.

An electric pump may include a motor module including a rotating shaft, a rotor coupled to an outer circumferential surface of the rotating shaft, a stator configured to accommodate the rotor, and a motor housing configured to accommodate the rotor and the stator; and a pump module including a pump rotor coupled to one end of the rotating shaft, and a pump housing configured to accommodate the pump rotor, wherein the pump housing includes a rotor accommodating part having an insertion groove formed therein to accommodate the pump rotor; and a third cover connected with the rotor accommodating part and having a fluid sucking hole and a fluid discharging hole.

The rotor accommodating part may further include a protrusion configured to extend outwardly and having a through-hole, and the motor housing may include a fastening groove corresponding to the through-hole, and the electric pump may further include a fastening member sequentially fastened to the through-hole and the fastening groove.

The motor housing may include a through-hole configured to support one end of the rotating shaft. A fluid may be introduced into a gap between the through-hole and the rotating shaft.

The electric pump may include a sealing member disposed between the through-hole and the rotor. The electric pump may include a first cover configured to cover the motor module, a motor driving part coupled to the first cover, and a second cover configured to cover the motor driving part. The electric pump may include a bearing configured to support the other end of the rotating shaft.

The rotor accommodating part may include a first groove formed in a bottom surface of the insertion groove to receive a fluid. The motor housing may include a second groove formed at a surface thereof facing the rotor accommodating part to correspond to the first groove. A depth of the first groove may be larger than or the same as a depth of the second groove.

The rotor accommodating part may include a groove portion configured to surround the insertion groove, and an O-ring arranged in the groove portion. The rotor accommodating part may include an insertion hole formed at a center of a bottom surface of the insertion groove to support one end of the rotating shaft. The rotor accommodating part may be integrally formed with the third cover.

The pump rotor may include an internal rotor coupled to one end of the rotating shaft, and an external rotor configured to accommodate the internal rotor.

The terms including an ordinal number such as first, second, etc. can be used to describe various construction elements, but the construction elements should not be limited by those terms. The terms are used merely for the purpose to distinguish an element from another element. For example, a first element may refer to a second element, and similarly, a second element may refer to a first element without departing from the scope of the claims of the invention. The term "and/or" encompasses a combination of plural items or any one of the plural items.

It is to be noted that, in this specification, the expression that "a certain construction element is connected to another construction element" means that the certain construction element is directly connected to another construction element, and also means that a third construction element may be interposed therebetween. On the other hand, the expression that "the certain construction element is directly connected to another construction element" means that the third construction element is not interposed therebetween.

The terms used herein are merely to describe a specific embodiment, and thus the present disclosure is not limited thereto. Further, unless a singular expression clearly denotes a different meaning in context, it also includes a plural expression. It is understood that terms "comprises", "comprising", "includes" or "has" intend to indicate the existence of features, numerals, steps, operations, elements and components described in the specification or the existence of a combination of thereof, and do not exclude the existence of one or more other features, numerals, steps, operations, elements and components or the existence of the combination of thereof or additional possibility beforehand.

Unless otherwise defined, all terms including technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined here.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An electric pump comprising:

a motor housing;

a stator disposed in the motor housing;

a rotor disposed in the stator; and a shaft coupled to the rotor and passing through the motor housing;

a pump housing disposed on the motor housing;

a pump rotor coupled to the shaft; and an O-ring disposed between a first surface of the pump housing and a first surface of the motor housing facing the first surface of the pump housing, wherein the pump housing comprises a first recess disposed on the first surface of the pump housing, a plurality of second recesses disposed on a bottom surface of the first recess to receive a fluid, and a third recess disposed on the bottom surface of the first recess, wherein the motor housing includes second grooves disposed on the first surface of the motor housing and corresponding to the second recesses, and wherein the pump rotor is disposed in the first recess.

2. The electric pump of claim 1, wherein the pump housing comprises first protrusions protruding from an outer circumferential surface of the pump housing and the motor housing comprises coupling parts protruding from an outer circumferential surface of the motor housing to be coupled to the first protrusions.

3. The electric pump of claim 2, wherein the pump housing comprises first through-holes disposed at each of the first protrusions and the motor housing comprises second through-holes disposed at each of the coupling parts, wherein the first through-holes and second through-holes are coupled by respective fastening members.

4. The electric pump of claim 1, wherein the plurality of second recesses comprises two second recesses, wherein the third recess is disposed between the two second recesses.

5. The electric pump of claim 4, wherein the third recess is surrounded by the two second recesses.

6. The electric pump of claim 4, wherein one of the second recesses is larger than the other second recess.

7. The electric pump of claim 1, wherein the pump housing comprises a fourth recess disposed on the first surface of the pump housing to receive the O-ring.

8. The electric pump of claim 1, wherein the first surface of the pump housing contacts with the first surface of the motor housing.

9. The electric pump of claim 8, wherein the first surface of the pump housing and the first surface of the motor housing are comprised of a flat surface.

10. The electric pump of claim 2, further comprising a third cover connected with the pump housing and having a fluid sucking hole and a fluid discharging hole.

11. The electric pump of claim 10, wherein the third cover comprises second protrusions protruding between the first protrusions.

12. The electric pump of claim 1, further comprising a first cover configured to cover the motor housing, a second cover disposed on the first cover, and a circuit substrate disposed between the first cover and the second cover.

13. The electric pump of claim 1, wherein a depth of the second recesses is greater than a depth of the second grooves.

14. The electric pump of claim 1, wherein the pump rotor comprises an internal rotor coupled to the shaft, and an external rotor configured to accommodate the internal rotor.

15. The electric pump of claim 12, wherein one portion of the shaft is supported by a third through-hole disposed on the motor housing and another portion of the shaft is supported by a bearing.

16. The electric pump of claim 15, wherein the third through-hole is disposed on one side of the rotor and the bearing is disposed on the other side of the rotor, and wherein the shaft is inserted into an open hole of the first cover so that a second end of the shaft faces the circuit substrate.

17. The electric pump of claim 12, wherein the first cover includes a first part protruding in an axial direction to support one side of the circuit substrate and a second part protruding from an inner wall of the open hole to support an outer portion of the bearing.

18. An electric pump comprising:

a motor housing;

a stator disposed in the motor housing;

a rotor disposed in the stator;

a shaft coupled to the rotor and passing through the motor housing;

a pump housing disposed on the motor housing;

a pump rotor coupled to the shaft; and an elastic member disposed between the pump housing and the motor housing, wherein the pump housing comprises a first recess disposed on the pump housing, two second recesses disposed on a bottom surface of the first recess, and a third recess disposed on the bottom surface, wherein one of the second recesses is disposed at one side of the third recess and the other second recess is disposed at another side of the third recess, and wherein the motor housing includes second grooves disposed on the first surface of the motor housing and corresponding to the second recesses.

19. The electric pump of claim 18, wherein the pump housing comprises first protrusions protruding from an outer circumferential surface of the pump housing and the motor housing comprises coupling parts protruding from an outer circumferential surface of the motor housing to be coupled to the first protrusions, wherein the pump housing comprises first through-holes disposed at each of the first protrusions and the motor housing comprises second through-holes disposed at each of the coupling parts, wherein the first through-holes and second through-holes are coupled by respective fastening members.

* * * * *